US006505566B1

(12) United States Patent
Foster et al.

(10) Patent No.: US 6,505,566 B1
(45) Date of Patent: Jan. 14, 2003

(54) SUPPORT ASSEMBLY

(75) Inventors: Gregory J. Foster, Chicago, IL (US); Jeffrey D. Bransky, Chicago, IL (US); Robert W. Sheldon, Chicago, IL (US); Howard Danzyger, Aurora, IL (US); Matt Millies, Park Ridge, IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 09/737,664

(22) Filed: Dec. 14, 2000

(51) Int. Cl.[7] ..... A47B 11/00
(52) U.S. Cl. ..... 108/138; 108/50.01; 108/95
(58) Field of Search ..... 108/142, 94, 95, 108/50.01, 138; 248/918, 202.1, 222.13, 222.52, 125.7

(56) References Cited

U.S. PATENT DOCUMENTS 4,863,124 A * 9/1989 Ball et al. ..... 248/918 X
5,443,237 A * 8/1995 Stadtmauer ..... 248/918 X
5,636,822 A 6/1997 Hendershot et al.
5,730,408 A 3/1998 McAllister et al.
5,975,469 A * 11/1999 Chen ..... 248/918 X
5,984,244 A 11/1999 Hirschovits et al.
6,042,064 A * 3/2000 Hong ..... 248/918 X
6,045,098 A 4/2000 Timm
6,086,034 A 6/2000 McAllister et al.
6,296,215 B1 * 10/2001 McCoy et al. ..... 248/918 X
6,296,216 B1 * 10/2001 Law et al. ..... 248/918 X

* cited by examiner

*Primary Examiner*—Jose V. Chen
(74) *Attorney, Agent, or Firm*—Brinks Hofer Gilson & Lione

(57) ABSTRACT

A support assembly is provided that includes a platform and an arm. The arm has a first end and a second end. The second end of the arm is attached to the platform. The first end of the arm rotatably and slidably engages with a support guide so that the arm and platform move between a raised and a storage position.

22 Claims, 2 Drawing Sheets

SUPPORT ASSEMBLY

FIELD OF THE INVENTION

The present invention relates to a support assembly and in particular to a support assembly that includes a work platform that can be moved to one of a use position and a storage position.

BACKGROUND OF THE INVENTION

Typically, when tasks are performed on a work surface, such as a table or desk, additional space that is in close proximity to the work surface is often needed to carry out additional or related tasks. One such example is when additional space is needed to support items that aid in the preparation of food. Another example is the use of a computer, a keyboard, and a mouse or other input device. Generally, the mouse or input device is located adjacent the keyboard.

Because plentiful workspace is highly desirable, computer keyboard trays that attach to the underside of the desk are known and commercially available. These known computer keyboard trays generally provide an area for locating a mouse and/or mouse pad. Unfortunately, these trays tend to be unduly large and cumbersome. One solution to that problem has been to provide a mouse tray that attaches to the keyboard tray and provides a support for a computer mouse or other input device. This solution, however, presents several problems. First, the mouse tray generally is not at the same height as the keyboard and may therefore produce undesirable ergonomic implications. Second, additional support is often required to support the mouse and mouse pad. Furthermore, when the additional support surface is no longer needed, it too takes up valuable space.

As a result, supports are made that swivel out from under a flat surface when in use. These supports, however, are inconvenient to use because they are located at a position below the flat surface, and when the supports are in use, they cannot be raised to a location in closer to the flat surface.

Other supports are often stored by being slidably received by a passage that passes through the work surface. An example of such a configuration is disclosed in U.S. Pat. No. 6,045,098. This patent discloses a computer keyboard support that has a moveable mouse extension that passes through a keyboard support. Before the mouse extension can be stored, however, the mouse must first be removed from the mouse extension. The present invention solves the disadvantages of the prior art by providing a support assembly that allows a platform to be rotated from a work position to a storage position.

BRIEF SUMMARY OF THE INVENTION

The support assembly of the present invention includes a support guide, a platform, and an arm having a first end and a second end. The second end is attached to the platform and the first end rotatably and slidably engages with the support guide.

In another embodiment, the first end has a downwardly extending tube that rotatably and slidably engages with the support guide.

In a preferred embodiment, the support guide has a top side for attachment with a platform. The support guide also has at least one stop and an outer surface. The outer surface has a V-shaped channel that is continuous about the outer surface. The V-shaped channel has at least one horizontal top position and at least one horizontal bottom position.

The present invention therefore provides a support assembly upon which numerous tasks may be performed and upon which various items may be placed. Advantageously, the support assembly may be raised to be in close proximity to other items to facilitate the performance of various tasks. The support assembly and any items being supported by the support assembly may be conveniently stored when they are no longer needed.

The foregoing and other features and advantages of the invention will become apparent from the following detailed description of the presently preferred embodiments, read in conjunction with the accompanying drawings. While the invention will be described in the following specification by reference to computer keyboards, keyboard trays, and computer input devices such as computer mice, it is to be understood that such reference is merely to help the reader understand the features of the present invention. One of skill in the art will understand the many applications of the support assembly of the present invention and that reference to its use with computer keyboards does not limit its applicability.

DETAILED DESCRIPTION OF THE PRESENTLY PREFERRED EMBODIMENTS

Figure 1:
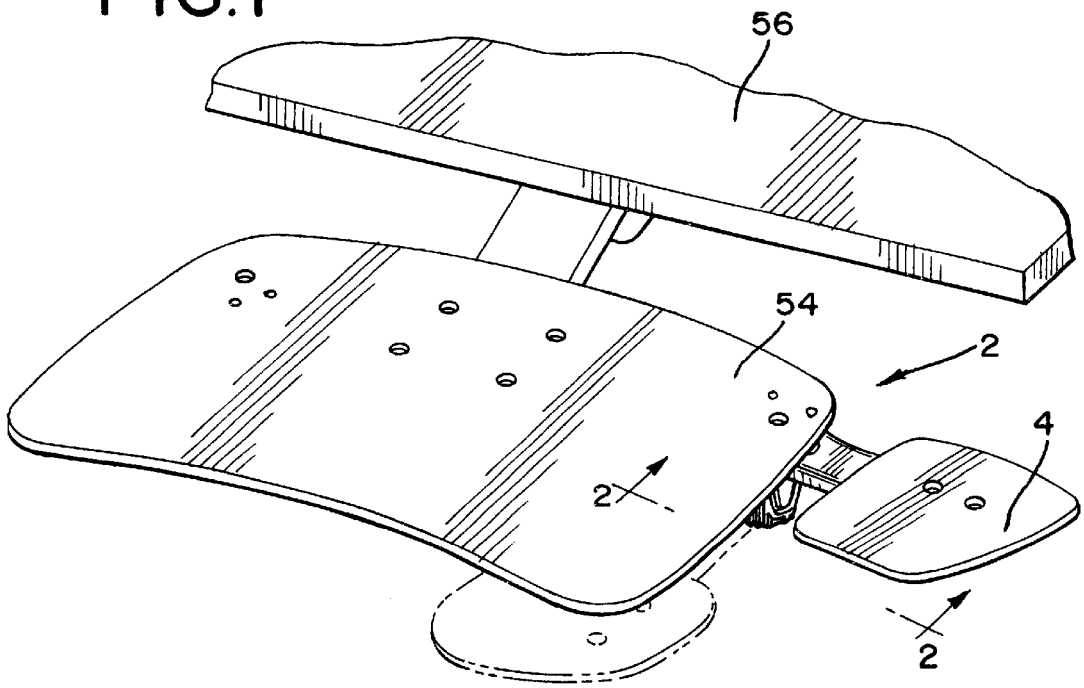
FIG.1 is a perspective view of a preferred embodiment of the support assembly of the present invention where the support assembly is attached to a computer keyboard tray.
Figure 2:
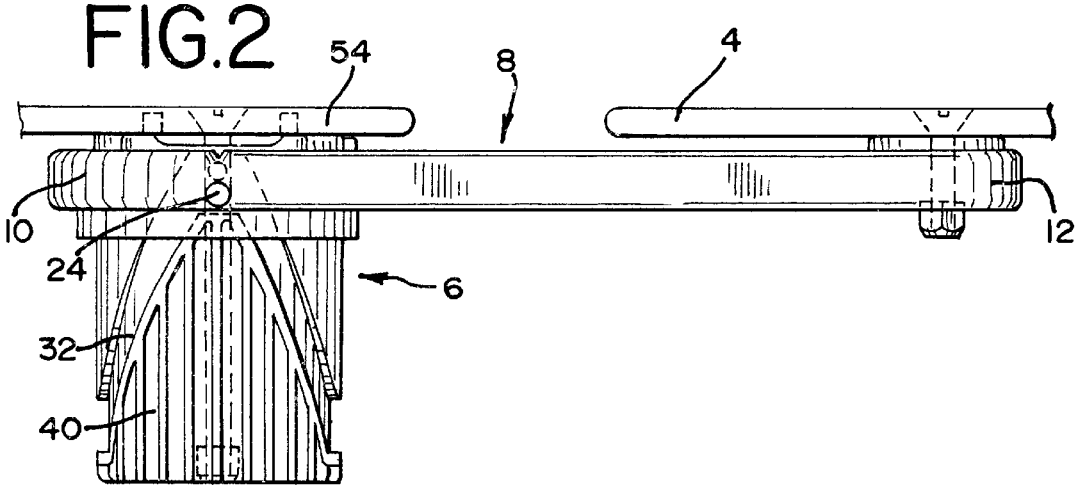
FIG. 2 is a side view of the support assembly of FIG. 1 along the line 2—2 showing platform in a raised position.

Turning now to FIGS. 1 & 2, one embodiment of the support assembly 2 of the present invention includes a support guide 6, an arm 8, and a platform 4. The arm 8 includes a first end 10 and a second end 12.

The platform 4 can be used as a support upon which numerous tasks may be performed, and upon which various items may be placed. It may have various shapes and can be made of various materials. Examples include, but are not limited to, plastics, metals, wood, or rubber. Preferably, the platform is substantially flat.

Figure 4:
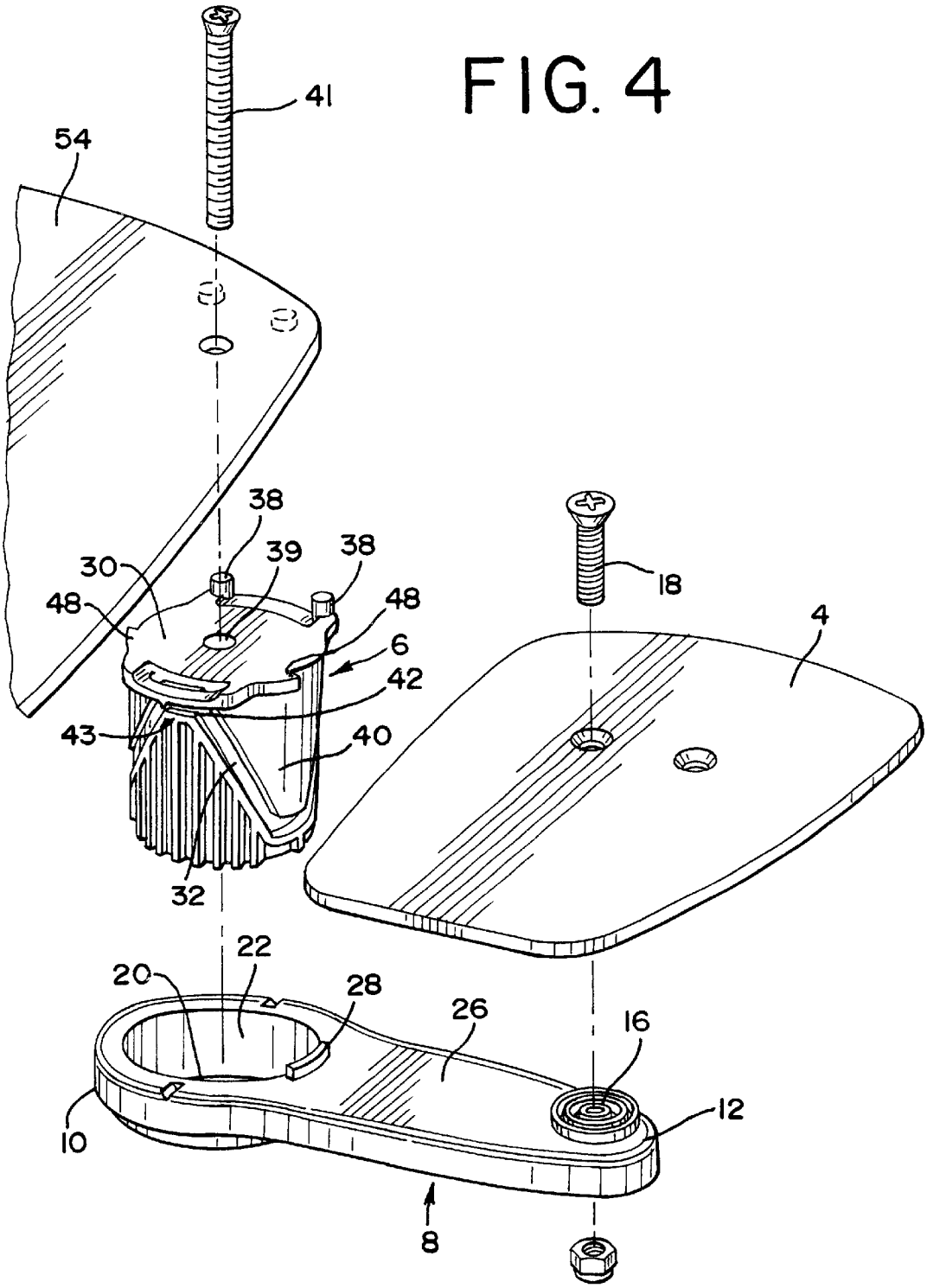
FIG. 4 is an exploded, perspective view of a preferred embodiment of the support assembly.

The second end 12 is attached to the platform. In one embodiment, a hole 16 is provided on the second end and it receives a screw 18 to attach the second end with the platform (FIG. 4). Other methods may also be used to attach the second end 12 to the platform. For example, the second end can have at least one raised member so that the platform may be slidably attached with the second end.

The first end 10 of the arm has a top surface 26 and an opening 20 for receiving the support guide. The opening 20 includes an inner surface 22 and a cam 24. Preferably, at least one stop 28 is located on the top surface 26, at the periphery of the opening 20.

The support guide includes a top wall 30, at least one support guide stop 48, and an outer surface 40 having a channel 32. In a preferred embodiment, the top wall 30 has two upwardly extending prongs 38 and an opening 39 to receive a screw 41. In other embodiments, the top wall may merely have one attachment, such as, by way of example, a screw, bolt, prong, or a frictional attachment. In alternative embodiments, the top surface may have a plurality of attachments. In yet other embodiments, the top surface may merely have at least one opening for receiving an attachment located on a keyboard tray 54.

In this embodiment, the support assembly is attached to a computer keyboard tray 54 that is in turn attached to a work surface 56, such as a desk, a table, a counter or the like. It is to be understood that the computer keyboard tray may have any of several aesthetic or functional features, which are not important to the support assembly of the present invention.

Alternatively, the support assembly can be attached directly to a work surface such as a tabletop or desktop. Preferably, the article to which the support assembly is attached has suitable open space beneath its bottom surface so that the support assembly can be attached.

Figure 3:
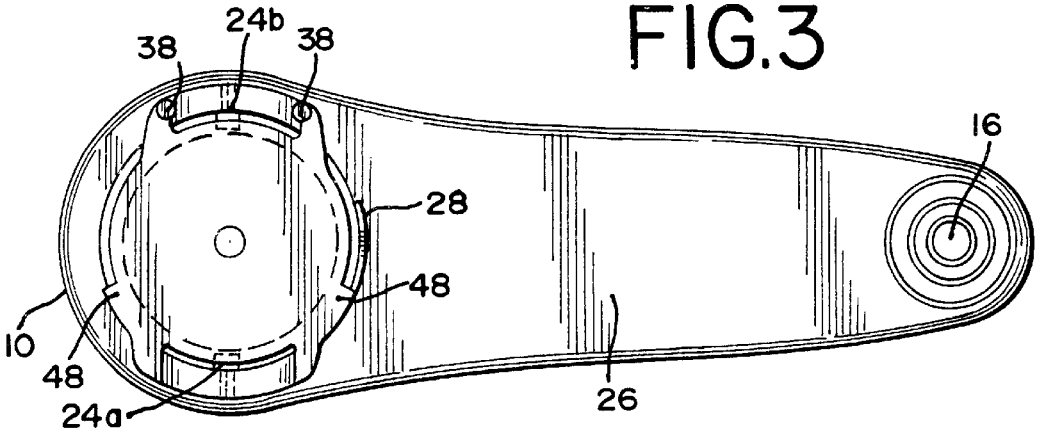
FIG. 3 is a top view of a preferred embodiment of the support assembly.

Although the support guide has at least one support guide stop 48, in a preferred embodiment, shown in FIG. 3, there are two support guide stops 48. Preferably, the support guide stops 48 are substantially coplanar with the top wall 30 and extend outwardly and horizontally from the top wall 30. In other embodiments, the support guide stops may upwardly or downwardly extend from the top wall. As will be further discussed below, the support guide stops 48 and the stop 28 limit arm rotation.

Preferably, the channel 32 is V-shaped and continuous about the outer surface 40 of the support guide and spans the length of the outer surface. The channel includes at least one top part 42 that has a substantially horizontal cam rest 43. The channel 32 may be formed by any suitable manufacturing method, such as molding, milling, or the like.

The assembly, installation, and use of the support assembly will now be described. The opening 20 of the first end 10 of the arm receives and surrounds the support guide, and the channel 32 receives the cam 24. The platform is attached to the second end 12 of the arm. The top wall 30 is attached to the keyboard tray.

The support assembly, when assembled and installed, can be moved into at least two positions, a stored position and a raised position. To move the support assembly into a raised position, the platform is moved in an upwardly direction away from the keyboard tray. As a result, the cam 24 travels in an upwardly direction along the channel 32, and the arm rotates so that the second end of the arm moves in an outwardly direction relative to the keyboard tray.

Upon reaching a raised position, the cam 24 enters the top part 42 of the channel 32 and is supported by the cam rest 43, allowing the arm to remain in a raised position. The support guide stop 48 contacts the stop 28 on the top surface 26, and prevents the cam 24 from traveling past the cam rest 43.

Referring to FIG. 3, 24*a* depicts the position of the cam 24 in a raised position when the support assembly is installed to the right side of a user facing the keyboard tray. Alternatively, 24*b* depicts the position of the cam 24 in a raised position when the support assembly is installed to the left side of a user facing the keyboard tray.

Once the support assembly enters a raised position, it will be in close proximity to the keyboard tray. Advantageously, the platform may also be at the same height as the keyboard tray. Numerous items may be supported by and numerous tasks may be performed on the platform, either in conjunction with or in addition to any items or tasks associated with the keyboard tray or any other type of work surface. For example, the platform can be used to support a mouse pad and mouse or other input device for use with a computer keyboard. Alternatively, the platform can be used as a reading or writing surface. As additional examples, the platform may be used as a cutting board for preparing food items, or may be used as a tray for supporting food items to be consumed.

When not in use, the support assembly may be placed in a storage position. To move the support assembly into a storage position, the platform is pulled in a downwardly direction and in a direction toward the keyboard tray. The cam 24 travels in a downwardly direction along the channel 32, and the arm rotates so that the second end of the arm rotates toward the keyboard tray.

Upon reaching a storage position, the platform and arm will be stored beneath the keyboard tray. FIG. 1 depicts in dashed lines the support assembly in a stored position beneath the keyboard tray.

In other embodiments the support assembly may be vertically adjusted. The top surface of the support guide can have a downwardly extending projection attached with the bottom surface of the keyboard tray. The downwardly extending projection may be adapted to fit within an upwardly facing space defined by an inner surface in the support guide. When the support assembly is in a raised position, it may be vertically adjusted by having at least one stop on the inner surface enter into and out of engagement with at least one stop on the downwardly extending projection. Thus the support assembly will be able to achieve a plurality of vertical positions relative to the downwardly extending projection.

The advantages of the above-described embodiments of the support assembly of the present invention are numerous. For example, the entire support assembly, as well as any items on the platform, may be conveniently stored when not in use. Other support systems often require a user to remove items from a platform before storing the assembly. Furthermore, the support assembly may be raised upwardly relative to a storage position, allowing a user to more easily access the platform and materials supported by the platform. Other systems will merely "swing out" from a stored position, and cannot be raised to a height that is more convenient for a user.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A support assembly comprising:

a support guide;

a platform; and an arm having a first end and a second end with the first end in simultaneous rotatable and slidable engagement with the support guide and with the second end attached to the platform such that the second end and platform simultaneously move vertically and horizontally with respect to the support guide.

2. The support assembly of claim 1, wherein the first end further includes an interior surface defining a passage.

3. The support assembly of claim 2, wherein the support guide includes an outer surface having a channel within which to slidably receive the first end.

4. The support assembly of claim 3, wherein the first end of the arm includes a travel member that engages the channel.

5. The support assembly of claim 3, wherein the channel is V-shaped.

6. The support assembly of claim 5, wherein the channel is continuous about the periphery of the support guide.

7. The support assembly of claim 6, wherein the channel further comprises at least one top position.

8. The support assembly of claim 1, wherein the support guide further comprises at least one support guide stop.

9. The support assembly of claim 8, wherein the arm further comprises at least one stop on a top surface of the first end.

10. The support assembly of claim 1, wherein the first end of the arm further comprises an inner surface and a downwardly extending projection adapted to be in slidable engagement with each other such that the platform attains a plurality of vertical positions relative to the downwardly extending projection.

11. The support assembly of claim 10, wherein the downwardly extending projection further comprises at least one stop, and wherein the inner surface further comprises at least one stop.

12. A support assembly comprising:

a support guide;

a platform; and an arm having a first end and a second end, wherein the first end has a downwardly extending tube in simultaneous rotatable and slidable engagement with the support guide and wherein the second end is attached with the platform such that the second end and platform simultaneously move vertically and horizontally with respect to the support guide.

13. The support assembly of claim 12, wherein the downwardly extending tube further comprises an inner surface defining an open space.

14. The support assembly of claim 13, wherein the support guide includes an outer surface having a channel within which to slidably receive the first end.

15. The support assembly of claim 14, wherein the inner surface of the downwardly extending tube includes a travel member that rotatably and slidably engages with the channel of the support guide.

16. The support assembly of claim 14, wherein the channel is V-shaped.

17. The support assembly of claim 16, wherein the channel is continuous around the periphery of the support guide.

18. The support assembly of claim 17, wherein the channel further comprises at least one top position such that the travel member remains in a raised position by engaging with the top position.

19. A support guide for attachment to a platform comprising:

a top side for attachment with the platform;

a channel having a repeating V-shaped pattern, wherein the channel is continuous about an outer surface of the support guide, the channel having at least one horizontal top position; and at least one stop attached to the top side.

20. A support assembly comprising:

a support guide that includes an outer surface having a channel;

a platform; and an arm having a first end and a second end, the first end including an interior surface defining a passage;

wherein the first end is received within the channel of the support guide such that the first end is in simultaneous rotatable and slidable engagement with the support guide and wherein the second end is attached to the platform.

21. A support assembly comprising:

a support guide;

a platform; and an arm having a first end that includes an inner surface and a downwardly extending projection, and a second end, the first end in simultaneous rotatable and slidable engagement with the support guide and the second end attached to the platform, wherein the inner surface and the downwardly extending projection of the first end of the arm are adapted to be in slidable engagement with each other such that the platform attains a plurality of vertical positions relative to the downwardly extending projection.

22. A support assembly comprising:

a support guide that includes an outer surface having a channel;

a platform; and an arm having a first end and a second end, the first end having a downwardly extending tube that includes an inner surface that defines an open space to receive the support guide, wherein the downwardly extending tube is received within the channel such that the first end is in simultaneous rotatable and slidable engagement with the support guide and wherein the second end is attached with the platform.

* * * * *